United States Patent [19]

Hatta

[11] Patent Number: 4,487,373

[45] Date of Patent: Dec. 11, 1984

[54] TRAVERSE TAKE-UP APPARATUS FOR MATERIAL OF INDEFINITE LENGTH

[75] Inventor: Keiso Hatta, Toyama, Japan

[73] Assignee: Yoshida Kogyo K. K., Tokyo, Japan

[21] Appl. No.: 474,159

[22] Filed: Mar. 10, 1983

[30] Foreign Application Priority Data

Mar. 29, 1982 [JP] Japan ..... 57-49167

[51] Int. Cl.[3] ..... B65H 54/10; B65H 54/32

[52] U.S. Cl. ..... 242/16; 242/43.1; 242/158.3; 242/158.4 R

[58] Field of Search ..... 242/43.1, 43 R, 25 R, 242/16, 17, 158.2, 158.3, 158.4 R

[56] References Cited

U.S. PATENT DOCUMENTS

| | | | |
|---|---|---|---|
| 808,468 | 12/1905 | Moriggl | 242/43.1 |
| 1,425,655 | 8/1922 | Huttinger | 242/43.1 |
| 1,728,448 | 9/1929 | Schubert | 242/43.1 |
| 1,900,480 | 3/1933 | Bartholomew | 242/43.1 |
| 1,927,307 | 9/1933 | Carter | 242/43.1 X |

FOREIGN PATENT DOCUMENTS

| | | | |
|---|---|---|---|
| 535913 | 2/1922 | France | 242/43.1 |
| 1082127 | 6/1954 | France | 242/43.1 |
| 189788 | 8/1923 | United Kingdom | 242/16 |
| 567673 | 2/1945 | United Kingdom | 242/43.1 |
| 607416 | 8/1948 | United Kingdom | 242/43.1 |
| 856559 | 12/1960 | United Kingdom | 242/43.1 |

*Primary Examiner*—Stanley N. Gilreath

*Attorney, Agent, or Firm*—Hill, Van Santen, Steadman & Simpson

[57] ABSTRACT

A traverse take-up apparatus for material of indefinite length such as thread, tape and the like comprising a winding beam having tapered flanges at the opposite ends thereof and a rotary shaft, a beam rotating means, a material guide means for traversing in parallel to the beam rotary shaft and a traverse distance adjusting mechanism adapted to increase the traverse distance of the material guide means as the material is wound in successive layers on a winding beam is disclosed. The traverse distance adjusting mechanism includes two parallel traverse screw shafts disposed in parallel to the beam rotary shaft with the traverse distance on one of the traverse screw shafts set for a predetermined minimum winding width and the traverse distance on the other of the traverse screw shafts set for a predetermined maximum winding width. The traverse distance adjusting mechanism further includes a rocker rod engaged to the traverse screw shafts, a slider mounted on the rocker rod and slidable along the length of the same and a screw shaft mounted on the material guide means at right angles to the traverse direction of the guide means and being in threaded engagement with the slider. The rotations of the beam rotary shaft, the traverse screw shafts and the screw shaft are interlocked with each other under a predetermined speed relationship.

8 Claims, 5 Drawing Figures

TRAVERSE TAKE-UP APPARATUS FOR MATERIAL OF INDEFINITE LENGTH

BACKGROUND OF THE INVENTION

This invention relates to a take-up apparatus for material of indefinite length such as thread, rope and the like to be subjected to dyeing or liquid treatment in which the material is helically wound in a plurality of layers about a winding beam with tapered flanges and more particularly, has its purpose to provide an apparatus for material of indefinite length in which the traverse movement distance of a material guide means is increased as the diameter of the roll of material being wound on the winding area of the beam between the opposite tapered flanges increases so that the material is traversely and suitably fed to the tapered winding area on the flanges at the opposite ends of the beam and thereby the material is uniformly wound in layers in a stabilized condition.

It has been conventionally known that material of relatively small width and of indefinite length such as thread, tape, rope and the like to be subjected to dyeing or liquid treatment is traversely wound in layers on the porous winding barrel of a winding beam having flanges at the opposite ends. But the winding beam with flat flanges has the disadvantage that when the material wound in layers is subject to liquid treatment such as dyeing, since the opposite ends of the material layers offer a low resistance to the liquid passing through the material layer ends, the material layer areas are excessively treated. Thus, in order to eliminate such disadvantage, the inner side faces of the flanges have been conventionally tapered.

However, when material of indefinite length is wound on the winding beam having tapered flanges, a traverse distance varying means is necessary to gradually increase the traverse distance of the material so that the material can be uniformly wound in layers on the tapered faces and as such traverse distance varying means, an electrical or mechanical means has been proposed. However, the conventional electrical or mechanical means has a complicated mechanism and encounters difficulties in handling. Thus, there has been demand for a stable and positive take-up apparatus for material of indefinite length.

SUMMARY OF THE INVENTION

In order to meet the demand, the present invention has successfully provided a take-up apparatus for material of indefinite length which has a simple construction which is stable and positive in operation and which can adjust the traverse distance. Furthermore, the take-up apparatus of the present invention is easily adaptable to parallel winding by slow traverse and layer winding such as twill winding by quick traverse.

Especially, when the material of indefinite length to be handled is an uneven tape such as a tape having a reinforcing core along one side edge thereof, a stringer having slide fastener elements secured along the reinforced side edge thereof or a fastener chain comprising two stringers engaging with each other, layers formed of such a material become relatively unstable and often cause partial variation in the density of material layers under the pressure of liquid passing through the layers same which wound lead to uneven dyeing and treatment and furthermore would cause undesirable deformation such as the formation of corrugations in the tape. In order to eliminate such difficulties it is desirable to wind the material or tape in twilled layers at an angle to each other. However, the conventional take-up apparatus can not satisfactorily attain such winding mode. The present invention can quite effectively attain the purpose.

According to the present invention, the take-up apparatus for material of indefinite length comprises a winding beam having tapered flanges at the opposite ends thereof and a rotary shaft, a beam rotating means, a material guide emans movable in parallel to said rotary shaft of the beam and a traverse distance adjusting mechanism adapted to increase the reciprocal movement distance or traverse distance of the material guide means as the number of layers of the material wound on the beam increases. The traverse distance adjusting mechanism includes two parallel traverse screw shafts in parallel to said rotary shaft of the beam with the traverse distance on one of the two traverse screw shafts set for a predetermined minimum winding width and the traverse distance on the other of the traverse screw shafts set for a predetermined maximum winding width. The traverse distance adjusting mechanism further includes a rocker rod engaged to said two traverse screw shafts, a slider movable along the length of said rocker rod and a screw shaft in threaded engagement with said slider and provided on said material guide means at right angles to the traverse direction of said material guide means, the rotation of said beam rotary shaft, said traverse screw shafts and said screw shaft are interlocked with each other under a predetermined speed relationship.

The above and other objects and attendant advantages of the present invention will be more readily apparent to those skilled in the art from a reading of the following detailed description in conjunction with the accompanying drawings which show one preferred embodiment of the present invention for illustration purpose only, but not for limiting the scope of the same in any way.

DESCRIPTION OF THE PREFERRED EMBODIMENTS

The present invention will be now described referring to the accompanying drawings which show one embodiment of the invention.

Figure 1:
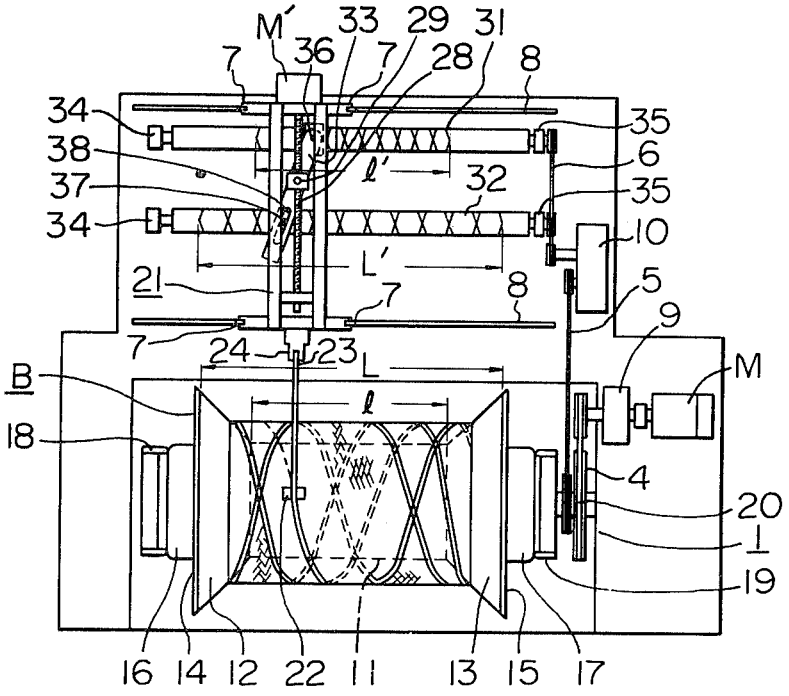
FIG. 1 is a plan view of the take-up apparatus of the present invention.
Figure 2:
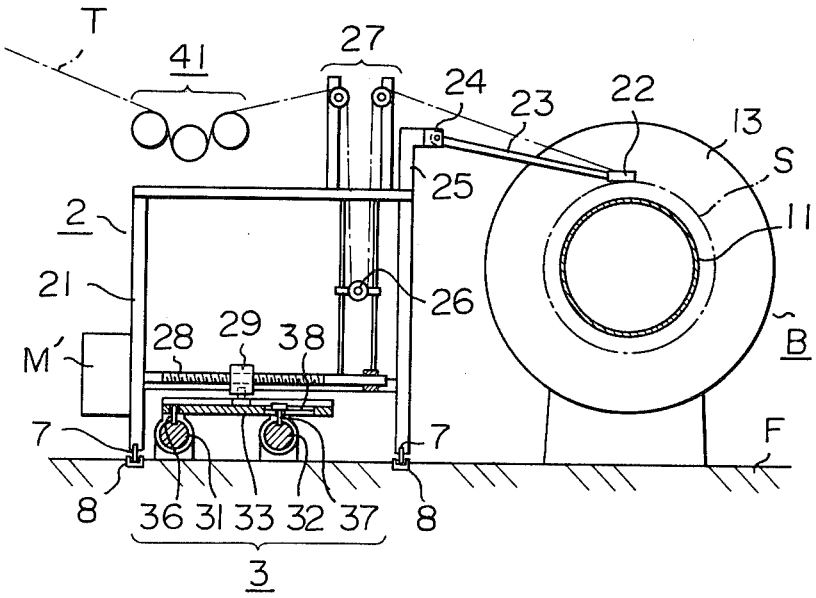
FIG. 2 is a side elevational view of said apparatus as shown in FIG. 1 showing a portion thereof in section.

In the drawings, FIG. 1 is a plan view of the take-up apparatus having a beam B mounted thereon constructed in accordance with the present invention and FIG. 2 is a side elevational view of the take-up apparatus showing a portion thereof in section. The beam B comprises a winging barrel 11 which has at the opposite ends tapered flanges 14, 15 provided with tapered winding faces 12, 13 on the inner sides thereof, respectively, and hollow cylindrical lugs 16, 17 projecting outwardly from the tapered flanges 14, 15, respectively.

The beam B is rotated by a beam rotating means 1 which comprises a support 18 fitted in and rotatably supporting the lug 16 and a support 19 fitted in and holding the lug 17. The support 19 is operatively connected to a rotary drive means 20 which is in turn driven from a motor M through a reduction gear 9 and a wheel - belt arrangement.

A guide means 2 for guiding material of indefinite length includes a frame work 21 provided at the lower end thereof with four wheels 7,7,7,7 which run along a pair of rails 8,8 laid on the floor F in parallel to the rotary shaft of the beam B supported by the beam-rotating means. Provided on the side of the framework 21 facing the beam B is a guide bar 23 having one end provided with a guide 22 for guiding material on the beam B and the other end pivoted at the upper end of a stay 25 by means of a pivot pin 24. Also provided on the guide means 2 is roller mechamism 27 comprising rollers disposed in different heights and including a vertically movable tension regulation roller 26 for transferring material T of indefinite length.

A screw shaft 28 is rotatably journalled in a lower portion of the framework 21 in a direction at right angles to the direction of the movement of the guide means 2 and has one end connected to a fine adjusting rotary motor M'.

A traverse distance adjusting mechanism 3 includes a pair of parallel traverse screw shafts 31, 32 and a rocker rod 33 in threaded engagement with the screw shafts. The traverse screw shafts 31, 32 are journalled at the opposite ends thereof on the floor F by means of bearings 34,34 and 35,35, respectively and an interlocking chain 6 is trained about the sprockets at the ends of the screw shafts 31, 32 where the shafts are journalled by the bearings 35,35.

The traverse screw shafts 31, 32 are formed with forward and reverse grooves and engaging pieces 36, 37 engage in the screw grooves so that as the traverse screw shafts 31, 32 rotate, the engaging pieces 36, 37 move reciprocally along the shafts. The reciprocal movement distance l' the engaging piece 36 on the screw shaft 31 is set for a predetermined minimum winding width l or the width of the winding barrel 11 of the take-up beam B having tapered flanges and the reciprocal movement distance L' of the engaging piece 37 on the screw shaft 32 is set for a predetermined maximum winding width L of the beam or the distance between the outer peripheral edges of the tapered flanges and extreme ends of these distances l' and L' are aligned with ends of the widths l and L respectively in the direction perpendicular to the shafts 31, 32.

The rocker rod 33 is pivoted at one end to the engaging piece 36 associated with the traverse screw shaft 31 and formed at the other end with an elongated stepped slot 38 for receiving the head of the engaging piece 37 associated with the traverse screw shaft 32.

Reference numeral 10 denotes a variable speed change gearing for transmitting the rotation of the rotary shaft for rotating the beam B to the traverse screw shafts 31, 32 and a timing belt or chain arrangement interlocks between the beam, traverse screw shafts and variable speed change gearing.

With the above-mentioned construction and arrangement of the components of the take-up apparatus of the present invention, the apparatus can suitably wind thread or tape of indefinite length on the winding barrel of the beam in different winding modes such as parallel winding and diagonal or twill winding at different angles.

FIGS. 1 and 2 show the take-up apparatus in an intermediate stage during the winding operation. Material T of indefinite length is supplied from a supply source (not shown) and transferred through a tension guide roller group 41 and the roller mechanism 26 of the material guide means 2 onto the winding barrel 11 and tapered winding faces 12, 13 of the beam B to be wound thereabout. The rotation of the beam B is transmitted through the motor M, reduction gear 9 and belt 4 to the rotary drive means 20 and also transmitted through the chain 5, speed change gearing 10 and chain 6 to the traverse screw shafts 31, 32 to rotate the shafts.

As mentioned hereinabove, the traverse screw shafts 31, 32 are formed with forward and reverse screw grooves and the opposite ends of the rocker rod 33 are engaged to the screw shafts 31, 32 by means of the engaging pieces 36, 37, respectively.

The screw pitch of the traverse screw shafts 31, 32 is so set that, when the rocker rod 33 is positioned in the center of the reciprocal distances l' and L' on the traverse screw shafts 31, 32, respectively, the longitudinal axis of the rocker rod 33 extends perpendicular to the axis of the rotary shaft for rotating the beam B and when the rocker rod 33 moves leftwards or rightwards from the centers of the reciprocal movement distances on the traverse screw shafts 31, 32, respectively, the rocker rod 33 performs a fan-like movement so that the engaging piece 37 inclines towards the flanges of the beam B. When the screw pitch of the traverse screw shafts 31, 32 is the same, the ratchets about which the chain 6 is trained are formed with different diameters to increase the rotational speed of the traverse screw shaft 32 so as to tune the traverse of the engaging pieces 36, 37 on the two traverse screw shafts whereby the traverse screw shafts operate in the same way.

Furthermore, a slider 29 is in threaded engagement with the screw shaft 28 on the framework 21 of the material guide means 2 to transmit the movement of the rocker rod 33 to the material guide means 2 and the slider 29 connects between the traverse adjusting mechanism 3 and material guide means 2. The screw shaft 28 is continuously rotated by the rotary motor M' as the material is wound in successive layers on the beam B or intermittently rotated when one winding layer is formed by a plural number of traverses, to increase the winding width of the material in conformity with the tapered winding faces.

Figure 3:
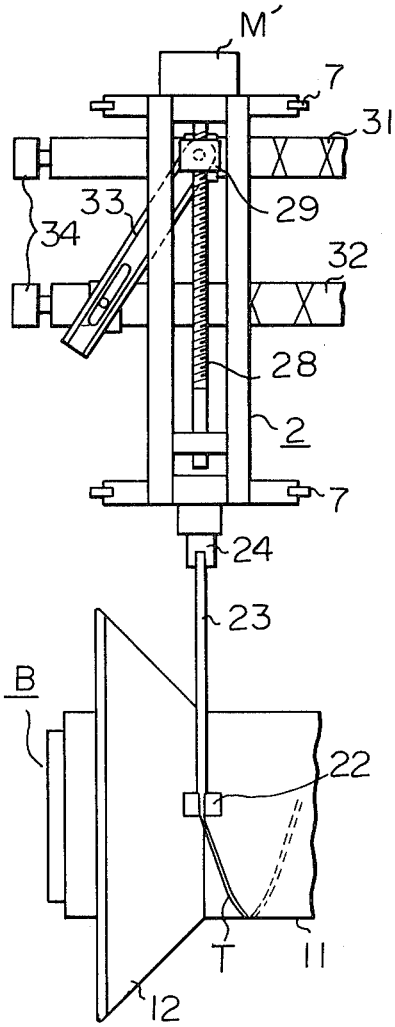
FIGS. 3 through 5 are fragmentary plan views of a portion of said apparatus showing the winding mode of material of indefinite length onto the tapered winding faces on the winding beam of said apparatus.
Figure 4:
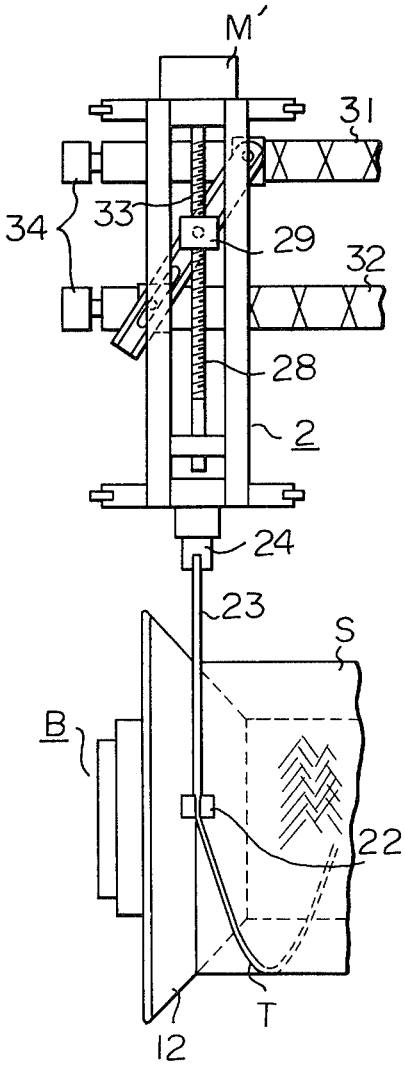
Figure 5:
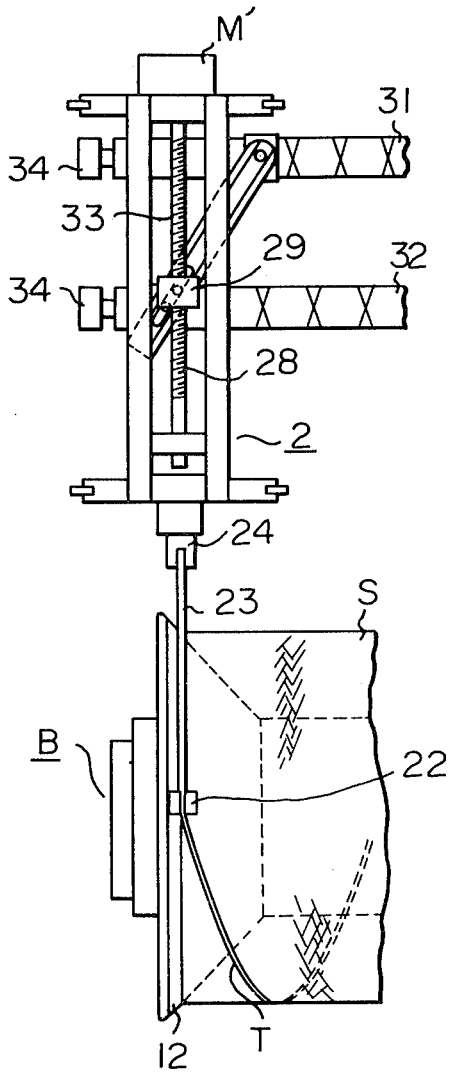

FIGS. 3 through 5 are plan views showing the increase of the winding width of the traverse take-up apparatus. Each of these Figures shows the time point when the guide 22 adapted to guide the material onto the beam winding surface has reached the left-hand tapered winding face 12.

In FIG. 3, the slider 29 lies in a position on the rocker rod 33 in which the first layer of material T has not been on the beam barrel 11 and the traverse screw shaft 31 reverses its rotational direction with the slider 29 positioned in a corresponding position on the rocker rod 33. In FIG. 4, the material T is wound in a plurality of layers S with the ends of the material layers lying along the tapered winding face 12 and the slider 29 has moved to an intermediate position along the screw shaft 28 by the rotation of the fine adjusting rotary motor M'. FIG. 5 shows the position of the apparatus at the time point approaching the completion of the winding operation in which the slider 29 is approaching the traverse screw shaft 32 and the rocker rod 33 has reached a position corresponding to the position of the slider 29.

In the illustrated embodiment, although the reciprocal movement distances l', L' of the rocker rod 33 on the traverse screw shafts 31, 32, respectively, are set to correspond to the minimum winding width l and the maximum winding width L on the beam B, respectively, in the present invention, the relationship between the reciprocal movement distances of the rocker rod is not limited to that described above, but the magnitude relationship between l' and l and that between L' and L can be optionally varied provided that the $l' < L'$ relationship is satisfied.

As described hereinabove, according to the present invention, the relative relationship between the rotational speed of the winding beam and the rotational speed of the traverse distance adjusting mechanism can be optionally varied by the variable speed change gearing 10 to thereby vary the traverse speed of the material guide means relative to the rotational speed of the winding beam so that an optional traverse winding can be uniformly performed on the beam winding barrel and tapered winding faces. Thus the material wound about the beam with tapered flanges can be effectively subjected to liquid treatment.

What is claimed is:

1. A traverse take-up apparatus for material of indefinite length such as thread, tape and the like comprising a winding beam having tapered flanges at the opposite ends thereof and rotatable on a rotary shaft, a beam rotating means for rotating said beam rotary shaft, a material guide means for traversing in parallel to said beam rotary shaft and a traverse distance adjusting mechanism adapted to move said material guide means as said material is wound in successive layers on said winding beam, said traverse distance adjusting mechanism having two parallel traverse screw shafts disposed in parallel to said beam rotary shaft with the traverse distance on one of said traverse screw shafts set for a predetermined minimum winding width and the traverse distance on the other of said traverse screw shafts set for a predetermined maximum winding width, said traverse distance adjusting mechanism further including a rocker rod threadably engaged to said traverse screw shafts, a slider mounted on said rocker rod and slidable along the length of the same and a screw shaft mounted on said material guide means at right angle to the traverse movement direction of said material guide means and being in threaded engagement with said slider, said screw shaft being mounted on a framework which forms a portion of said material guide means and is movable in parallel to said beam rotary shaft, and the rotations of said beam rotary shaft, said traverse screw shafts and said screw shaft are interlocked with each other under a predetermined speed relationship, wherein said beam rotating means is driven by a rotary motor means, said traverse screw shafts are driven via a speed change means from said rotary motor means, and said screw shaft is driven by a fine adjusting rotary motor means which is supported on said framework, whereby said slider is adapted to be moved along said rocker rod by the rotation of said fine adjusting rotary motor means.

2. The traverse take-up apparatus as set forth in claim 1, in which said rocker rod is engaged to said traverse screw shafts by means of engaging pieces in threaded engagement with each of said traverse screw shafts.

3. The traverse take-up apparatus as set forth in claim 2, in which one of said engaging pieces is pivoted to said rocker rod at its one end and the other of said engaging pieces is engaged in an elongated slot formed in said rocker rod at its the other end.

4. The traverse take-up apparatus as set forth in claim 1, in which the traverse distance on one of said traverse screw shafts is shorter than that on the other of said traverse screw shafts.

5. The traverse take-up apparatus as set forth in claim 4, in which said traverse distances on said one and the other of said traverse screw shafts correspond to the minimum winding width and the maximum winding width on said winding beam respectively.

6. The traverse take-up apparatus as set forth in claim 4, in which said traverse distances on said one and the other of said traverse screw shafts are different from the minimum winding width and the maximum winding width on said winding beam respectively.

7. The traverse take-up apparatus as set forth in claim 4, in which the screw pitch of one of said traverse screw shafts is smaller than that of the other of said traverse screw shafts.

8. The traverse take-up apparatus as set forth in claim 4, in which the screw pitch of one of said traverse screw shafts is the same as that of the other of said traverse screw shafts, means for providing different rotational speeds to said traverse screw shafts are provided.

* * * * *